US009355526B2

(12) United States Patent
DePalma et al.

(10) Patent No.: US 9,355,526 B2
(45) **Date of Patent: *May 31, 2016**

(54) GAMING MACHINE WITH AWARD BASED ON SUB-GAME OUTCOMES

(71) Applicant: Bally Gaming, Inc., Las Vegas, NV (US)

(72) Inventors: Michael DePalma, Reno, NV (US); Ryan Leach, Reno, NV (US); Dougal Austin, Reno, NV (US); Michael Delaney, Reno, NV (US); Joseph Kisenwether, Sparks, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 117 days.

This patent is subject to a terminal disclaimer.

(21) Appl. No.: 14/109,748

(22) Filed: Dec. 17, 2013

(65) Prior Publication Data

US 2014/0141855 A1 May 22, 2014

Related U.S. Application Data

(63) Continuation of application No. 12/272,341, filed on Nov. 17, 2008, now Pat. No. 8,613,647.

(51) Int. Cl.
*A63F 9/00* (2006.01)
*G07F 17/32* (2006.01)

(52) U.S. Cl.
CPC ..... *G07F 17/3293* (2013.01); *G07F 17/32* (2013.01); *G07F 17/3262* (2013.01)

(58) Field of Classification Search
None
See application file for complete search history.

(56) References Cited

U.S. PATENT DOCUMENTS 5,868,619 A * 2/1999 Wood ..... G07F 17/3244 273/292
6,146,271 A * 11/2000 Kadlic ..... A63F 1/00 273/292
6,219,836 B1 * 4/2001 Wells ..... G07F 17/32 463/25
6,224,482 B1 * 5/2001 Bennett ..... G07F 17/32 273/143 R
6,270,405 B1 * 8/2001 Ferguson ..... A63F 1/00 273/138.1
6,471,587 B1 * 10/2002 Wood ..... A63F 1/00 273/143 R
6,520,856 B1 * 2/2003 Walker ..... G07F 17/3244 463/21
6,585,587 B2 * 7/2003 Falciglia, Sr. ..... A63F 1/00 273/292
6,708,975 B1 * 3/2004 Fox ..... A63F 1/00 273/274
7,625,280 B2 * 12/2009 Singer ..... G07F 17/34 273/143 R
2002/0025846 A1 * 2/2002 Bennett ..... G07F 17/3244 463/20
2002/0068621 A1 * 6/2002 Stern, Jr. ..... G07F 17/3262 463/16
2002/0160830 A1 * 10/2002 Stern ..... G07F 17/3262 463/20
2003/0036422 A1 * 2/2003 Baerlocher ..... G07F 17/32 463/20
2003/0060268 A1 * 3/2003 Falconer ..... G07F 17/34 463/20

(Continued)

*Primary Examiner* — Seng H Lim
(74) *Attorney, Agent, or Firm* — Marvin Hein; Philip Anderson

(57) ABSTRACT

Disclosed are games, gaming machines, gaming systems and methods including a primary game award at least partially based on the outcomes of one or more sub-games. The outcomes are related according to a pay table associated with the primary game.

12 Claims, 10 Drawing Sheets

(56) References Cited

U.S. PATENT DOCUMENTS

2003/0064807 A1* 4/2003 Walker ..... G07F 17/32 463/42
2003/0119579 A1* 6/2003 Walker ..... G07F 17/32 463/20
2003/0125103 A1* 7/2003 Tessmer ..... G07F 17/32 463/20
2004/0038724 A1* 2/2004 Asdale ..... G07F 17/34 463/20
2004/0147306 A1* 7/2004 Randall ..... G07F 17/32 463/20
2005/0009597 A1* 1/2005 Daly ..... G07F 17/34 463/20
2005/0037837 A1* 2/2005 Rowe ..... G06Q 30/0209 463/25
2005/0054419 A1* 3/2005 Souza ..... G07F 17/32 463/20
2005/0143166 A1* 6/2005 Walker ..... G07F 17/3244 463/25
2005/0148384 A1* 7/2005 Marks ..... G07F 17/3265 463/20
2005/0181860 A1* 8/2005 Nguyen ..... G07F 17/3267 463/20
2006/0058097 A1* 3/2006 Berman ..... G07F 17/3244 463/20
2006/0135238 A1* 6/2006 Lancaster ..... G07F 17/32 463/12
2006/0252519 A1* 11/2006 Walker ..... G07F 17/32 463/25
2006/0287036 A1* 12/2006 Daly ..... G07F 17/3211 463/16
2007/0004495 A1* 1/2007 Kobayashi ..... G07F 17/34 463/16
2007/0037624 A1* 2/2007 Mitchell ..... G07F 17/32 463/20
2007/0105611 A1* 5/2007 O'Halloran ..... G07F 17/3244 463/16
2007/0218982 A1* 9/2007 Baerlocher ..... G07F 17/32 463/27
2007/0293293 A1* 12/2007 Baerlocher ..... G07F 17/32 463/16
2008/0039191 A1* 2/2008 Cuddy ..... G07F 17/32 463/25
2008/0076503 A1* 3/2008 Mattice ..... G07F 17/3244 463/16
2008/0220861 A1* 9/2008 Okada ..... G07F 17/3267 463/31
2008/0220881 A1* 9/2008 Okada ..... G07F 17/3267 463/43
2008/0242395 A1* 10/2008 Okada ..... G07F 17/32 463/20
2008/0242396 A1* 10/2008 Okada ..... G07F 17/32 463/20
2008/0242400 A1* 10/2008 Okada ..... G07F 17/32 463/25
2008/0242428 A1* 10/2008 Okada ..... G07F 17/32 463/43
2008/0318668 A1* 12/2008 Ching ..... G07F 17/3258 463/25
2009/0042645 A1* 2/2009 Graham ..... G07F 17/3258 463/27
2009/0088252 A1* 4/2009 Nicely ..... G07F 17/32 463/42
2009/0111574 A1* 4/2009 Rowe ..... G07F 17/32 463/25
2009/0143136 A1* 6/2009 Thomas ..... G07F 17/32 463/20
2009/0149240 A1* 6/2009 Abe ..... G07F 17/3293 463/20
2009/0270165 A1* 10/2009 Dias Pires ..... G07F 17/32 463/20

* cited by examiner

| | | # of mini-games with special symbol | | | | |
|---|---|---|---|---|---|---|
| | | 5 | 6 | 7 | 8 | 9 |
| # of mini-games played | 9 | | 2,000 | 20,000 | 200,000 | Level 1 |
| | 8 | 500 | 5,000 | 25,000 | Level 2 | |
| | 7 | 1,500 | 12,500 | Level 3 | | |
| | 6 | 2,000 | Level 4 | | | |
| | 5 | Level 5 | | | | |
| | 4 | | | | | |
| | 3 | | | | | |
| | 2 | | | | | |
| | 1 | | | | | |

FIG. 2

| | | # of mini-games with special symbol | | | | |
|---|---|---|---|---|---|---|
| | | 5 | 6 | 7 | 8 | 9 |
| # of mini-games played | 9 | | 2,000 | Level 7 | Level 4 | Level 1 |
| | 8 | 500 | 5,000 | Level 6 | Level 2 | |
| | 7 | 1,500 | 12,500 | Level 3 | | |
| | 6 | 2,000 | Level 5 | | | |
| | 5 | Level 8 | | | | |
| | 4 | | | | | |
| | 3 | | | | | |
| | 2 | | | | | |
| | 1 | | | | | |

FIG.3

GAMING MACHINE WITH AWARD BASED ON SUB-GAME OUTCOMES

RELATED APPLICATIONS

This application is a continuation of U.S. patent application Ser. No. 12/272,341 entitled "WAGERING GAME WITH AN AWARD BASED ON SUB-GAME OUTCOMES AND METHOD," filed on Nov. 17, 2008, hereby incorporated by reference in its entirety for all purposes.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The present invention is directed to wagering games, gaming machines, networked gaming systems and methods and, more particularly, to wagering games, gaming machines, networked gaming systems and methods having adjustable multi-part indicia.

2. Description of the Related Art

In the prior art, various types of gaming machines have been developed with different features to captivate and maintain player interest. In general, a gaming machine allows a player to play a game in exchange for a wager. Depending on the outcome of the game, the player may be entitled to an award which is paid to the player by the gaming machine, normally in the form of currency or game credits. Gaming machines may include flashing displays, lighted displays, or sound effects to capture a player's interest in a gaming device.

Another important feature of maintaining player interest in a gaming machine includes providing the player with many opportunities to win awards, such as cash or prizes. For example, in some slot machines, the display windows show more than one adjacent symbol on each reel, thereby allowing for multiple-line betting. Feature games of various types have been employed to reward players above the amounts normally awarded on a standard game pay schedule. Generally, such feature games are triggered by predetermined events such as one or more appearances of certain combinations of indicia in a primary game. In order to stimulate interest, feature games are typically set to occur at a gaming machine on a statistical cycle based upon the number of primary game plays.

Some gaming machine games today include one or more progressive prize awards. In some configurations, the progressive prize may have a small probability of a player winning it; thus making it possible to have a larger progressive prize. In other game configurations, the progressive prize may be a small amount; thus allowing the player patron to win the progressive prize more frequently. In most typical game configurations, the player wins the progressive prize as a result of a specific game outcome within the primary or main game.

While gaming machines including feature games and progressive prizes have been very successful, there remains a need for games that provide a player with enhanced excitement and increased opportunity of winning

SUMMARY OF THE INVENTION

In accordance with one or more embodiments of the invention, a gaming machine includes a processor operatively coupled to a set of player-operable controls and a plurality of sub-games from one or more of a reel game, wheel game, bingo game, poker game, or keno game, one or more of which may be enabled by the processor in accordance with the player-operable controls. Each enabled sub-game includes a sub-game outcome associated with a set of possible sub-game awards. A payout device pays at least one meta-game award distinct from the sub-game awards, the meta-game award based on at least one of the sub-game outcomes. A theoretical hold percentage of the meta game is maintained by altering the probability of the sub-game outcomes associated with the meta-game award based on the number of sub-games enabled for play.

Other features and advantages will become apparent from the following detailed description, taken in conjunction with the accompanying drawings, which illustrate by way of example, the features of the various embodiments.

BRIEF DESCRIPTION OF THE DRAWINGS

FIG. 2 illustrates an example pay table in accordance with one or more embodiments of the invention.

FIG. 3 illustrates another example pay table in accordance with one or more embodiments of the invention.

DETAILED DESCRIPTION OF THE INVENTION

Figure 1:
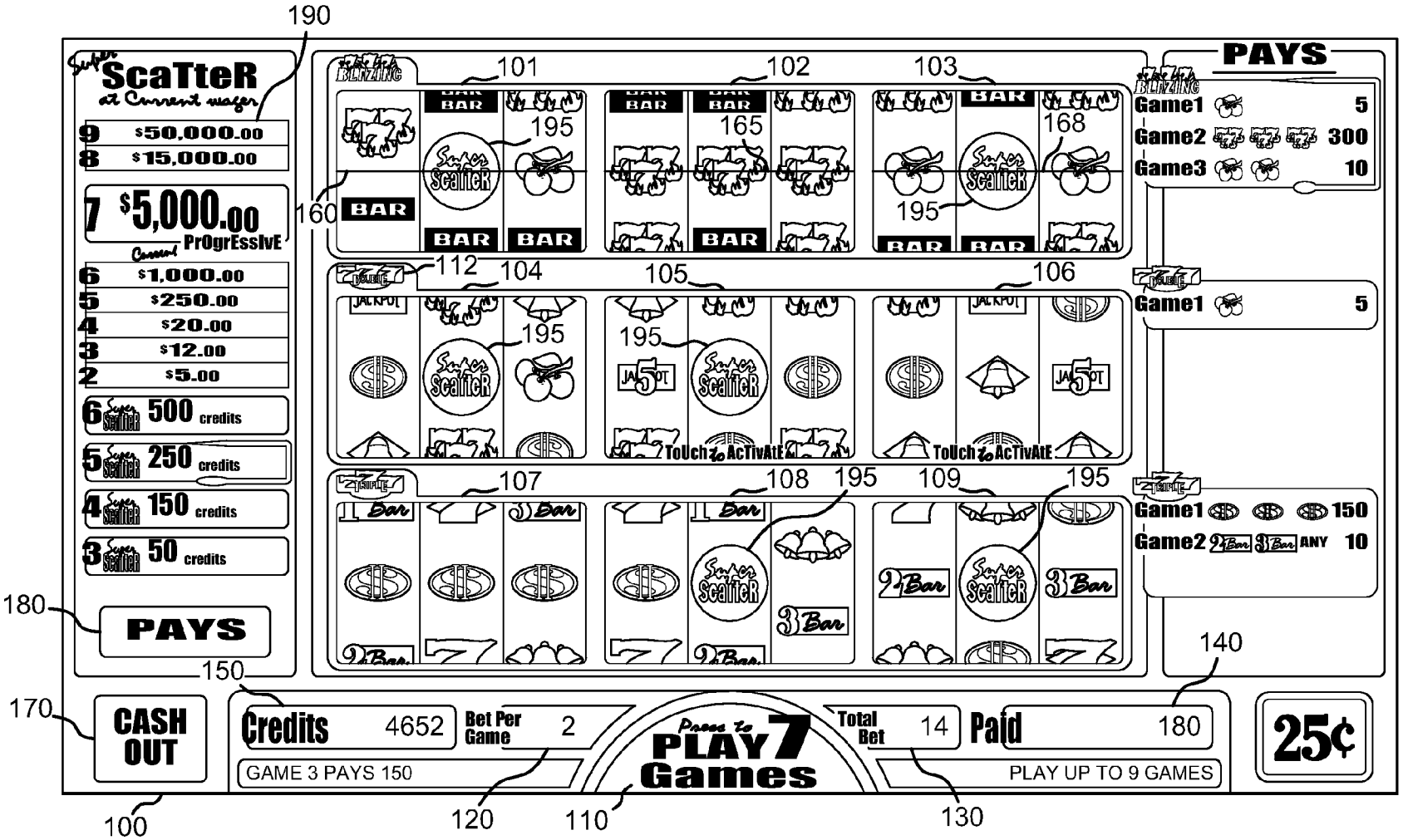
FIG. 1 provides an overview of a game of one embodiment of the invention.

Various embodiments are directed to a game, gaming machine, gaming networks and method for playing a game, wherein the game includes adjustable multi-part indicia. The embodiments are illustrated and described herein, by way of example only, and not by way of limitation. Referring now to the drawings, and more particularly to FIGS. 1-8, there are shown illustrative examples of games, gaming machines, gaming networks and methods for playing a game in accordance with various aspects of the invention.

An example game in accordance with one or more aspects of the invention is shown in FIGS. 1-2. Referring to FIG. 1, a primary or meta-game 100 is implemented using nine three-reel spinning mini-games 101-109. Each mini-game or sub-game has at least one pay line pattern passing through one indicium on each of its three reels. For example, pay line 160 extends horizontally through the center position of each of the three reels of mini-game 101. The number of pay lines and their patterns are by way of example only and may vary.

The player selects the number of mini-games 101-109 to play and the number of credits or coins wagered on each mini-game using touch screen controls or gaming device control buttons. In one embodiment, for example, the player may touch each mini-game he wishes to play in order to activate it. In the example shown in FIG. 1, mini-games 105 and 106 are not activated and may be activated by touching them. In another embodiment, the player may press a "quick pick" button (not shown) to randomly enable mini-games for play until a player-chosen number of mini-games have been enabled. In yet another embodiment, controls may allow the player to easily enable and wager on a predetermined number of games; for example, "Play 5 games at 2 credits per game."

The player's selections are displayed on games selected meter 110, per game bet meter 120 and TOTAL BET meter 130 located, which may be located in a "dashboard" on the game display or otherwise displayed, for example, on LED meters adjacent the display. Win PAID meter 140 and CREDITS meter 150 provide the player with information about the amount paid by the last game played and the total number of credits available for play. The player may collect the balance of his credits by pressing CASH OUT button 170.

The player initiates game play by pressing games selected meter 110, which, in this example, also serves as a touch screen "start" button. In some embodiments, the player may simultaneously select and start all games at the maximum number of coins or credits allowed per game by pressing a MAX BET button (not shown). Buttons (see FIG. 4, 460) on gaming machine 400 (FIG. 4) or touch screen buttons similar to button 110 may be used to perform the actions described here without deviating from the scope of the invention. The reels of mini-games 101-109 are made to spin and stop in predetermined stop positions. In one or more embodiments, the sub-games spin simultaneously. In other embodiments, each sub-game spins and stops prior to the start of the next sub-game or may partially overlap the prior sub-game's play. In another embodiment, all sub-games may spin and be stopped on demand by way of a player control. Once the sub-games are completed, a determination is then made whether the stop positions of the reels resulted in a winning game outcome for each of the mini-games.

The player may view a pay table associated with the primary or individual mini-games on the primary game display by way of PAYS touch screen button or a similar electromechanical button. In alternate embodiments, the pay table may be presented on a second video or printed display attached to the gaming device (i.e. display 453 or "pay glass" 452, FIG. 4). A winning combination, for example, could be two or more symbols adjacent to one another on an active pay line. For each winning combination, the game device awards the player the award in the pay table, adjusted as necessary based on the number of credits wagered on the mini-game pay line on which the win occurred. For example, three TRIPLE BLAZING 7 symbols adjacent to one another from left-to-right on an active pay line in games 101-103 might pay 300 times the player's wager.

In one or more embodiments, each mini-game may have a different game title and/or pay table or some or all mini-games may share common pay-tables. In FIG. 1, for example, games 101-103 share a common title and pay table, while games 104-109 share a second common title and pay table. In another embodiment, the player is allowed to cycle through a list of possible game titles for each mini-game by, for example, touching an icon 112 representing the mini-game title in a particular row or column. In some embodiments, selection of a new game title by pressing the icon or otherwise choosing a new mini-game title may change a group of mini-games to a common title for a corresponding row or column.

In accordance with one embodiment of the invention, a special slot symbol 195 has certain probabilities of appearing on the middle reel of each of the mini-games. The player may be awarded a primary game or meta-game award based on the number of mini-games showing this symbol on their pay line as part of their outcomes. The award may be a certain number of credits, a certain number of free games, or any other prize according to a pay table such as pay table 190. In some embodiments, the awards may include multipliers, In one or more embodiments, the prizes for feature game play may be set amounts, i.e. non-progressive. In some embodiments, the algorithms to determine the amounts may be determined by a statistical percentage based on an average take of a gaming machine and the likelihood of the win over a period of time. In the case where one or more gaming machines are networked, a common award table may be utilized where the award algorithms are determined based on an average take (total wagers) of all the networked gaming machines and the likelihood of a win of an award over a period of time. Each award may be calculated in a similar manner based on the likelihood of a winning outcome being achieved during a game play session.

In accordance with one or more embodiments of the invention, progressive prizes such as those shown in pay table 190 may be awarded. The progressive prizes may be calculated by a progressive controller such as a controller manufactured by Mikohn, Inc. The progressive controller monitors wagering during base game play, calculates a current value for one or more progressive jackpot pools and transmits the current pool values to the gaming machine. In one or more embodiments, progressive awards are accumulated during regular play as a percentage, such as three percent, of the game play take. The prizes may be sized according to the preferences of the casino operator. The number of prizes may vary without deviating from the scope of the invention. The size of the prizes is dependent on the amount of play prior to initiating feature play and may come from the contributions of a single gaming machine or a number of linked gaming machines. In another aspect, the prizes may be set amounts established by the casino operator from non-coin-in funds, such as marketing funds.

In one or more embodiments, the prizes for feature game play may be accumulated based on funding mechanisms other than a percentage of wagers accumulated by the gaming machine. For example, an operator may initially fund various award pools with a pre-determined amount of money, such as $1000 for one progressive, $500 for a second progressive, $100 for a third progressive and so on. Subsequently, the casino operator may determine to increase the amounts of one or more of the awards at pre-determined times which may be periodically or randomly selected with a range of times or periods. Once a winner has occurred at any level, the award levels may be rolled back to their initial funding amount. In one or more embodiments, only the winning award level is rolled back to the initial funding amount.

In accordance with other embodiments, the primary game includes a plurality of wagering mini-games of any type and title. While the example of FIG. 1 illustrates nine three-reel slot-machine reel mini-games arranged in three rows and three columns, the style of game and the number of rows and columns may vary. For example, in one embodiment, twelve five-reel slot games are arranged in three rows and four columns. In an alternate embodiment, the mini-games include one or more types of game such as slots, poker, bingo, keno and wheel games or the like. The player is allowed to play all or any subset of the available mini-games. At the conclusion of the mini-games, the collective outcome of the mini-games may result in a meta-game or primary game award. In one or more embodiments, the player may play the mini-games but eligibility to receive any additional meta-game award(s) may be based on the player's total wager amount or whether the player placed an additional meta-game side bet, whether the player has maintained a particular rate of play, or any other eligibility criteria which may be established by the rules of the game.

In some embodiments, the meta-game or primary game award is the result of one or more winning mini-game outcomes. For example, a primary game pay line including mini-game pay lines 160, 165 and 168 may indicate a winning result when each of pay lines 160, 165 and 168 display a mini-game winning combination, regardless of what each mini-game winning combination might be. In other embodiments, the mini-game outcomes need not be winning outcomes in order to pay a primary game award according to the primary game's pay table. For example, as described above, a common symbol, such as symbol 195, on each of pay lines 160, 165 and 168 might qualify as a winning primary game combination.

In FIG. 1, each mini-game is a 3-reel slot-type game in which special slot symbol 195 has a probability of occurring on the middle reel of each mini-game. The player wins a meta-game award based on the number of mini-games whose outcomes display the special symbol. In this example, the meta-game awards are a mixture of progressive amounts and fixed credit amounts. In accordance with one or more embodiments of the invention, the table in FIG. 2 may be used to determine a meta-game award based on the number of mini-games played versus the number of mini-games with the special symbol visible in its game outcome. In this example, the player must play a minimum of five mini-games and place a side bet on the meta-game to be eligible for a meta-game award.

In the table of FIG. 2, a reference to a "level" indicates a progressive award, with a Level 1 progressive generally, but not necessarily, paying more than a Level 2 progressive, a Level 2 progressive paying more than a Level 3 progressive, and so on. The table shows that a progressive award may be won by having each mini-game played display the special symbol as part of its outcome. The more mini-games played, the higher the progressive award potential. This encourages a player to wager more liberally in return for higher potential rewards.

A numerical table entry in the table of FIG. 2 indicates a credit award. For example, if the player plays six mini-games and five of the mini-games have a special symbol as part of their outcome, the player will be awarded 2,000 credits times the number of credits bet per mini-game.

In another example in accordance with one embodiment, the table of FIG. 3 shows various progressive levels associated with certain mini-game outcomes. In this example, the player has extra incentive to play eight or nine mini-games because a progressive award may be won even if all of the mini-games do not contain the special symbol in their outcomes. For example, a lesser Level 7 progressive award may be won if the player plays nine mini-games and only seven of the outcomes contain the special symbol.

In still other embodiments, the method of determining which meta-game award the player wins is based on the number of mini-games with a special symbol visible in its game outcome regardless of the number of mini-games played. An inherent problem with this approach is that the probability of getting, for example, five special symbols while playing nine mini-games is much greater than the probability of getting five special symbols while playing only five mini-games. This variation in probabilities causes undesired variations in the theoretical hold percentage of the game based on the number of mini-games played.

One method to overcome this problem is to utilize specific reel strips or specific weightings of the symbols on the reels based on the number of games the casino patron is playing. For example, when all nine mini-games are played, the game uses a set of reel strips which produce a less frequent occurrence of meta-game wins relative to when five mini-games are played, in which the game uses an alternate set of reel strips which produce a more frequent occurrence of meta-game wins.

Another method to overcome this problem is to require the player to play specific sets of mini-games, pre-selected by the game, whenever the player is playing less than all of the mini-games. These sets of mini-games are designed to produce more meta-game wins when fewer mini-games are played relative to less frequent meta-game wins when more mini-games are played.

Figure 4:
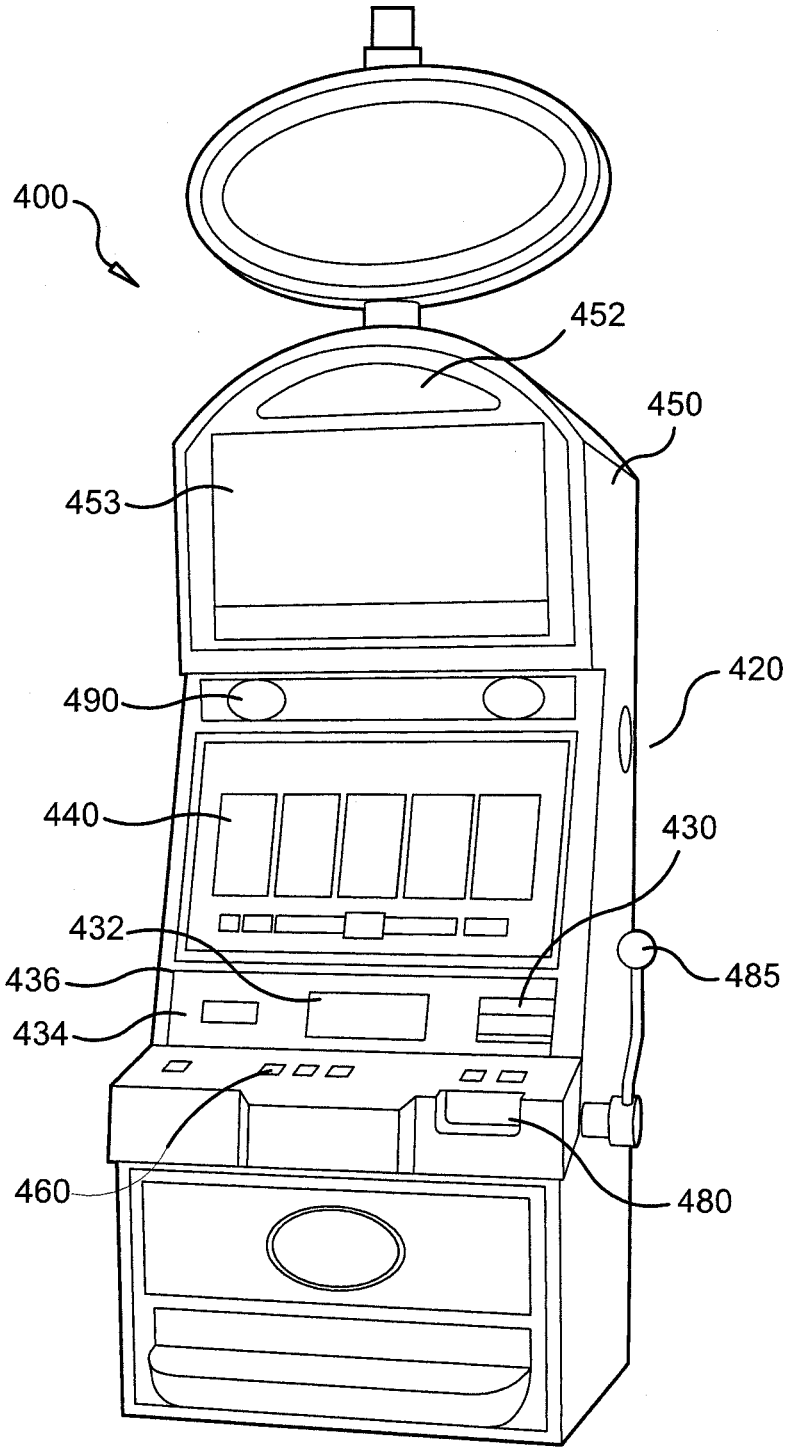
FIG. 4 is a perspective view of a gaming machine in accordance with one or more embodiments.

In accordance with one or more embodiments, FIG. 4 illustrates a gaming machine 200 including cabinet housing 220, primary game display 440 upon which a primary game and feature game may be displayed, top box 450 which may display multiple progressives that may be won during play of the feature game, player-activated buttons 460, player tracking panel 436, bill/voucher acceptor 480 and one or more speakers 490. Cabinet housing 420 is a self-standing unit that is generally rectangular in shape and may be manufactured with reinforced steel or other rigid materials which are resistant to tampering and vandalism. Cabinet housing 420 houses a processor, circuitry, and software (not shown) for receiving signals from the player-activated buttons 460, operating the games, and transmitting signals to the respective displays and speakers. Any shaped cabinet may be implemented with any embodiment of gaming machine 400 so long as it provides access to a player for playing a game. For example, cabinet 420 may comprise a slant-top, bar-top, or table-top style cabinet. The operation of gaming machine 400 is described more fully below.

The plurality of player-activated buttons 460 may be used for various functions such as, but not limited to, selecting a wager denomination, selecting a game to be played, selecting a wager amount per game, initiating a game, or cashing out money from gaming machine 400. Buttons 460 function as input mechanisms and may include mechanical buttons, electromechanical buttons or touch screen buttons. Optionally, a handle 485 may be rotated by a player to initiate a game.

In other embodiments, buttons 460 may be replaced with various other input mechanisms known in the art such as, but not limited to, a touch screen system, touch pad, track ball, mouse, switches, toggle switches, or other input means used to accept player input. For example, one input means is a universal button module as disclosed in U.S. application Ser. No. 11/106,212, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 420 may optionally include top box 450 which contains "top glass" 452 comprising advertising or payout information related to the game or games available on gaming machine 400. Player tracking panel 436 includes player tracking card reader 434 and player tracking display 432. Voucher printer 430 may be integrated into player tracking panel 436 or installed elsewhere in cabinet housing 420 or top box 450.

Game display 440 presents a game of chance wherein a player receives one or more outcomes from a set of potential outcomes. For example, one such game of chance is a video slot machine game. In other aspects of the invention, gaming machine 400 may present a video or mechanical reel slot machine, a video keno game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 440 is, typically, a CRT or a flat-panel display in the form of, but not limited to, liquid crystal, plasma, electroluminescent, vacuum fluorescent, field emission, or any other type of panel display known or developed in the art. Game display 440 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. A widescreen display in a "portrait" orientation may be 32 inches tall by 18 inches wide. Additionally, game display 440 preferably includes a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference.

Game display 440 may also present information such as, but not limited to, player information, advertisements and casino promotions, graphic displays, news and sports updates, or even offer an alternate game. This information may be generated through a host computer networked with gaming machine 400 on its own initiative or it may be obtained by request of the player using either one or more of the plurality of player-activated buttons 460; the game display itself, if game display 440 comprises a touch screen or similar technology; buttons (not shown) mounted about game display 440 which may permit selections such as those found on an ATM machine, where legends on the screen are associated with respective selecting buttons; or any player input device that offers the required functionality.

Cabinet housing 420 incorporates a single game display 440. However, in alternate embodiments, cabinet housing 420 or top box 450 may house one or more additional displays 453 or components used for various purposes including additional game play screens, animated "top glass," progressive meters or mechanical or electromechanical devices (not shown) such as, but not limited to, wheels, pointers or reels. The additional displays may or may not include a touch screen or touch glass system.

Figure 5A:
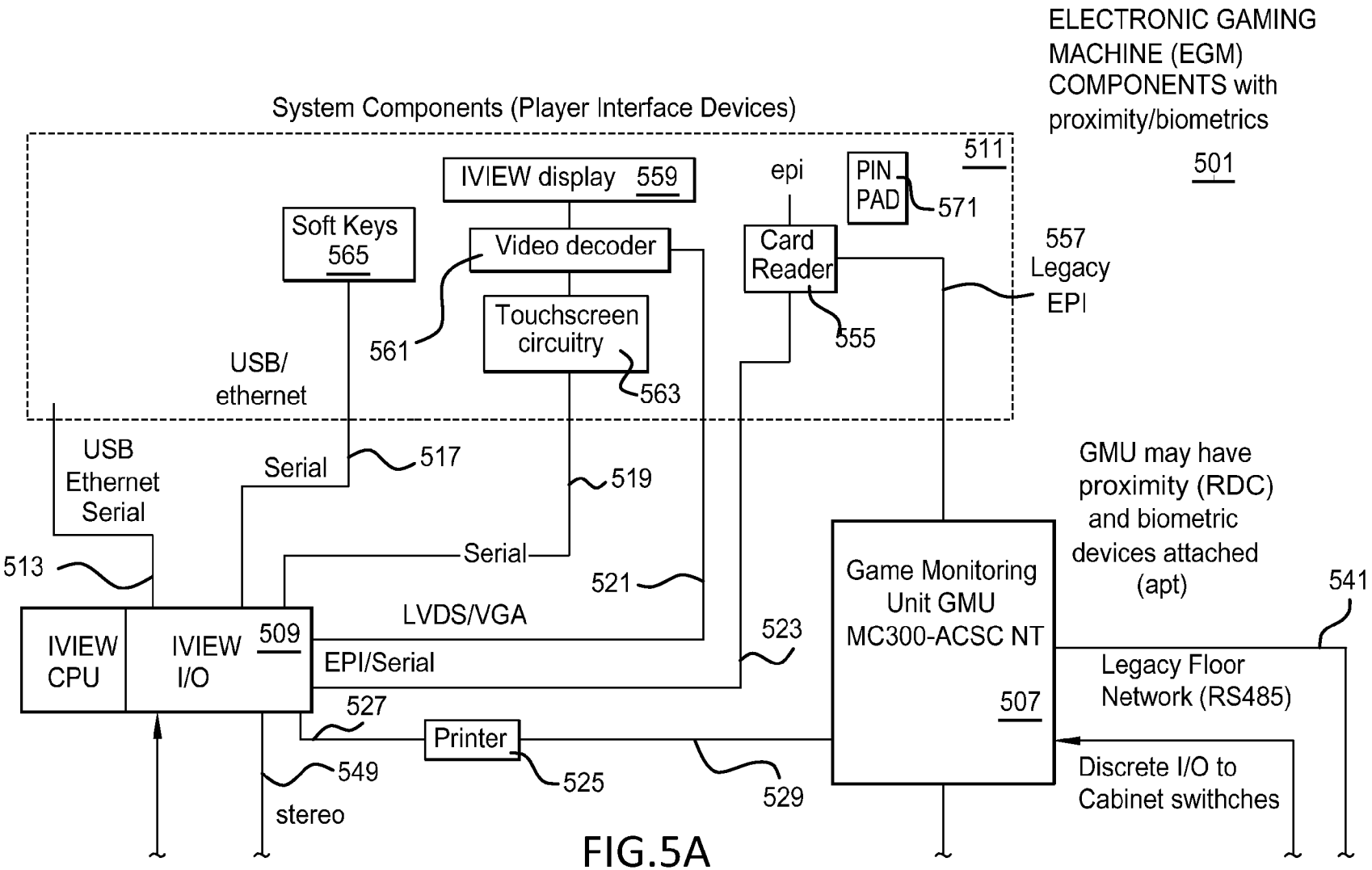
FIGS. 5A and 5B illustrate a block diagram of the physical and logical components of the gaming machine of FIG. 4.
Figure 5B:
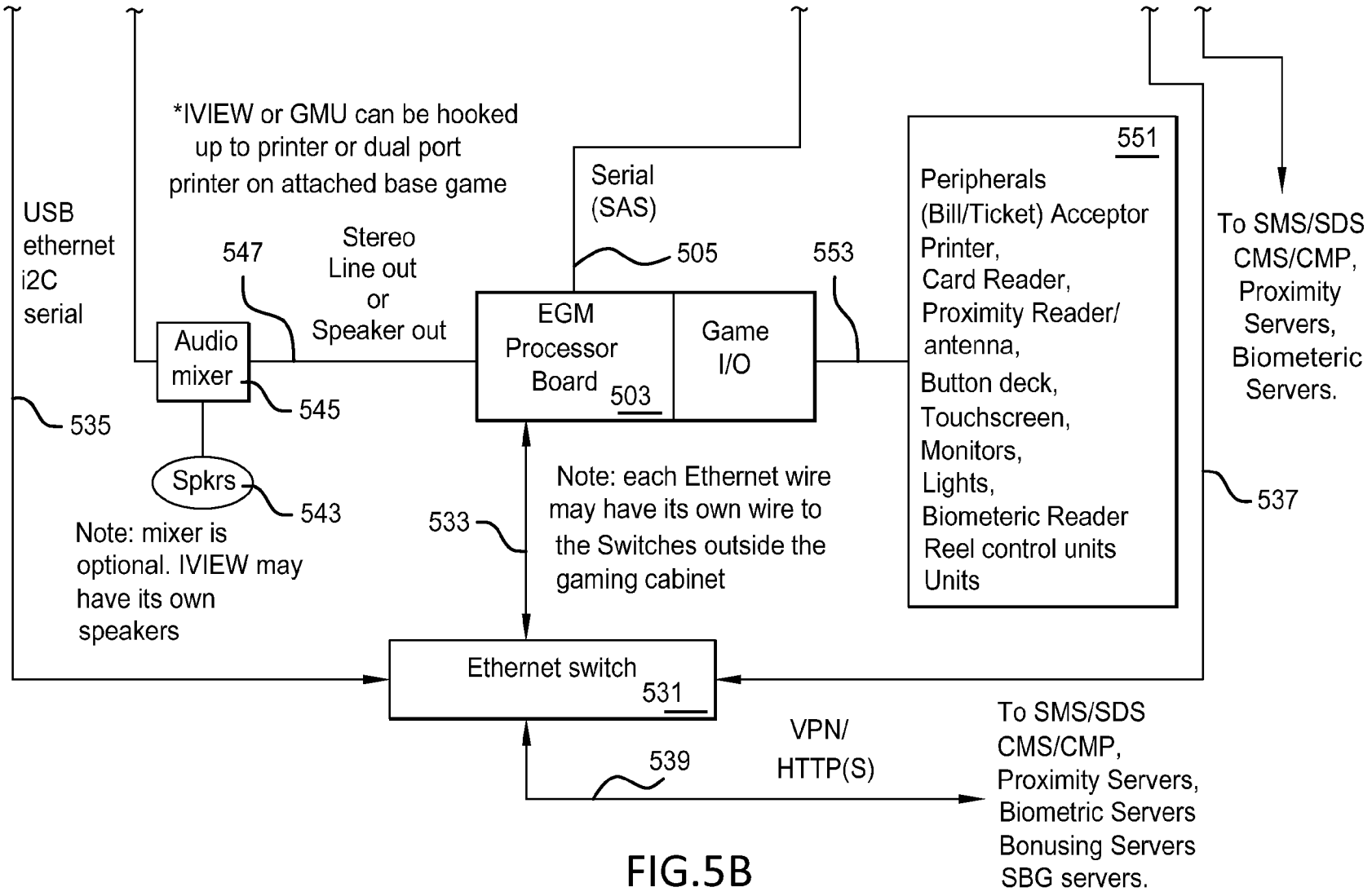

Referring to FIGS. 5A and 5B, electronic gaming machine 501 is shown in accordance with one or more embodiments. Electronic gaming machine 501 includes base game integrated circuit board 503 (EGM Processor Board) connected through serial bus line 505 to game monitoring unit (GMU) 507 (such as a Bally MC300 or ACSC NT), and player interface integrated circuit board (PIB) 509 connected to player interface devices 511 over bus lines 513, 515, 517, 519, 521, 523. Printer 525 is connected to PIB 509 and GMU 507 over bus lines 527, 529. EGM Processor Board 503, PIB 509, and GMU 507 connect to Ethernet switch 531 over bus lines 533, 535, 537. Ethernet switch 531 connects to a slot management system (SMS) and a casino management system (CMS) network over bus line 539. GMU 507 also may connect to the SMS and CMS network over bus line 541. Speakers 543 connect through audio mixer 545 and bus lines 547, 549 to EGM Processor Board 503 and PIB 509. The proximity and biometric devices and circuitry may be installed by upgrading a commercially available PIB 509, such as a Bally iView unit. Coding executed on EGM Processor Board 503, PID 509, and/or GMU 507 may be upgraded to integrate a game having adjustable multi-part indicia as is more fully described herein.

Peripherals 551 connect through bus 553 to EGM Processor Board 503. For example, a bill/ticket acceptor is typically connected to a game input-output board 553 which is, in turn, connected to a conventional central processing unit ("CPU") board 503, such as an Intel Pentium microprocessor mounted on a gaming motherboard. I/O board 553 may be connected to CPU processor board 503 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. Processor board 503 executes a game program that causes processor board 503 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of I/O board 553 to processor board 503 which, in turn, assigns an appropriate number of credits for play in accordance with the game program. The player may further control the operation of the gaming machine by way of other peripherals 551, for example, to select the amount to wager via electromechanical or touch screen buttons. The game starts in response to the player operating a start mechanism such as a handle or touch screen icon. The game program includes a random number generator to provide a display of randomly selected indicia on one or more displays. In some embodiments, the random generator may be physically separate from gaming machine 400; for example, it may be part of a central determination host system which provides random game outcomes to the game program. Thereafter, the player may or may not interact with the game through electromechanical or touch screen buttons to change the displayed indicia. Finally, processor board 503 under control of the game program and OS compares the final display of indicia to a pay table. The set of possible game outcomes may include a subset of outcomes related to the triggering of a feature game. In the event the displayed outcome is a member of this subset, processor board 503, under control of the game program and by way of I/O Board 553, may cause feature game play to be presented on a feature display.

Predetermined payout amounts for certain outcomes, including feature game outcomes, are stored as part of the game program. Such payout amounts are, in response to instructions from processor board 503, provided to the player in the form of coins, credits or currency via I/O board 553 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

One example of pseudo-code executed by the game microprocessor may include:

```
Start
if game activated, : game may be initiated by a player during
normal play by
    ; selecting a wager and selecting 'play' button, pulling
    ; lever, etc.; during tournament play, the EGM is set to play
    ; without additional wagers, and the player may simply
    ; select 'play' button, pull lever, etc. depending upon the;
    ; game
    call game sequence ; causing random number generator to
    ; determine a game outcome, presenting a game
    ; display such as mechanically or video spinning
    ; reels for a predetermined period, stopping the
    ; reels to show the determined game outcome,
    ; paying any awards by increasing the credit
    ; meter, advancing any other game state meters,
    ; and transmitting selected game play
    ; information including player information
    ; through the Ethernet switch to the SMS/CMS
    ; network. Depending upon programming, said
    ; information may be transmitted directly by
    ; EGM Processor Board 503 to the SMS/CMS
    ; network; alternatively, EGM Processor Board
    ; 503 may enable the information to be
    ; provided to PID 509 and/or GMU 507 for
    ; transmission to the SMS/CMS).
else
    while no activating signals,
    call attract mode ; causing a sample display of a game
sequence
    ; or presenting a display of a set of options for a
    ; player to initiate a game sequence such as
    ; minimum wager ($0.25, $1, $5) selection
    wend ; buttons in the case of a touch panel display.
    go to Start ; upon one or more activating signals, end
    ; attract mode and return to Start
end
```

GMU 507 includes an integrated circuit board and GMU processor and memory including coding for network communications, such as the G2S (game-to-system) protocol from the Gaming Standards Association, Las Vegas, Nev., used for system communications over the network. As shown, GMU 507 may connect to card reader 555 through bus 557 and may thereby obtain player card information and transmit the information over the network through bus 541. Gaming activity information may be transferred by the EGM Processor Board 503 to GMU 507 where the information may be translated into a network protocol, such as S2S, for transmission to a server, such as a player tracking server, where information about a player's playing activity may be stored in a designated server database.

PID 509 includes an integrated circuit board, PID processor, and memory which includes an operating system, such as Windows CE, a player interface program which may be executable by the PID processor together with various input/output (I/O) drivers for respective devices which connect to PID 509, such as player interface devices 511, and which may further include various games or game components playable on PID 509 or playable on a connected network server and PID 509 is operable as the player interface. PID 509 connects to card reader 555 through bus 523, display 559 through video decoder 561 and bus 521, such as an LVDS or VGA bus.

As part of its programming, the PID processor executes coding to drive display 559 and provide messages and information to a player. Touch screen circuitry interactively connects display 559 and video decoder 561 to PID 509, such that a player may input information and cause the information to be transmitted to PID 509 either on the player's initiative or responsive to a query by PID 509. Additionally soft keys 565 connect through bus 517 to PID 509 and operate together with display 559 to provide information or queries to a player and receive responses or queries from the player. PID 509, in turn, communicates over the CMS/SMS network through Ethernet switch 531 and busses 535, 539 and with respective servers, such as a player tracking server.

For example, PID 509 may have coding which is stored in local memory and executable by PID processor upon insertion of a player card into card reader 555 and follows a sequence such as:

```
Start:
Card detected ; a signal from card reader transmits to
    ; PID 509 upon insertion
Read player card information
    ; A player card has identifying information
    ; which may be used to identify a
    ; corresponding record in a player
    ; database where player tracking
    ; information is maintained, such as a PIN
    ; number for verifying a patron and the
    ; inserted card.
Access player account ; a message may be transmitted to a
player
    ; tracking server where a player account
    ; database may be maintained and
    ; accessed; the record may be located
    ; using the information from the player
    ; card.
Display player welcome message with player's name
If player's account has any information to be displayed,
    Display additional information
    ; For example, if playe has accumulated
    ; bonus points or has any bonus or promo
    ; awards, then the display may present
    ; that information
```

If player requests access to player's account,
Display query requesting input of PIN number
; A virtual key pad may be displayed
; upon which the player may press the
; correct sequence of keys or a separate
; PIN pad may be used, such as PIN pad
; 571.
If PIN confirmed, ; Upon receipt, the input PIN may be
; compared with a stored PIN associated
; with the player account. If the input PIN
; corresponds then the player is given
; access to the account.
Display available options ; For example, associated with respective
; soft keys 565, display bonus awards or
; promo credits available and enable
; activation of bonus awards or download
; of promo credits.
Send transaction message to EGM Processor Board effecting any authorized credit transaction
; EGM Processor Board 503 controls the
; credit meter displayed to player and
; controls release of credits to patron as
; through bus 553 connecting to
; peripherals 551. Pursuant to the
; transaction signal from PID 509, EGM
; Processor Board 503 transmits signal to
; credit meter and increases the number
; of credits by the authorized amount.

Player interface devices 511 are linked into the virtual private network of the system components in gaming machine 501. The system components include the iVIEW processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to install on the system components.

The system components include the iVIEW processing board and game monitoring unit (GMU) processing board. The GMU and iVIEW can combined into one like the commercially available Bally GTM iVIEW device. This device may have a video mixing technology to mix the EGM processor's video signals with the iVIEW display onto the top box monitor or any monitor on the gaming device.

Figure 6:
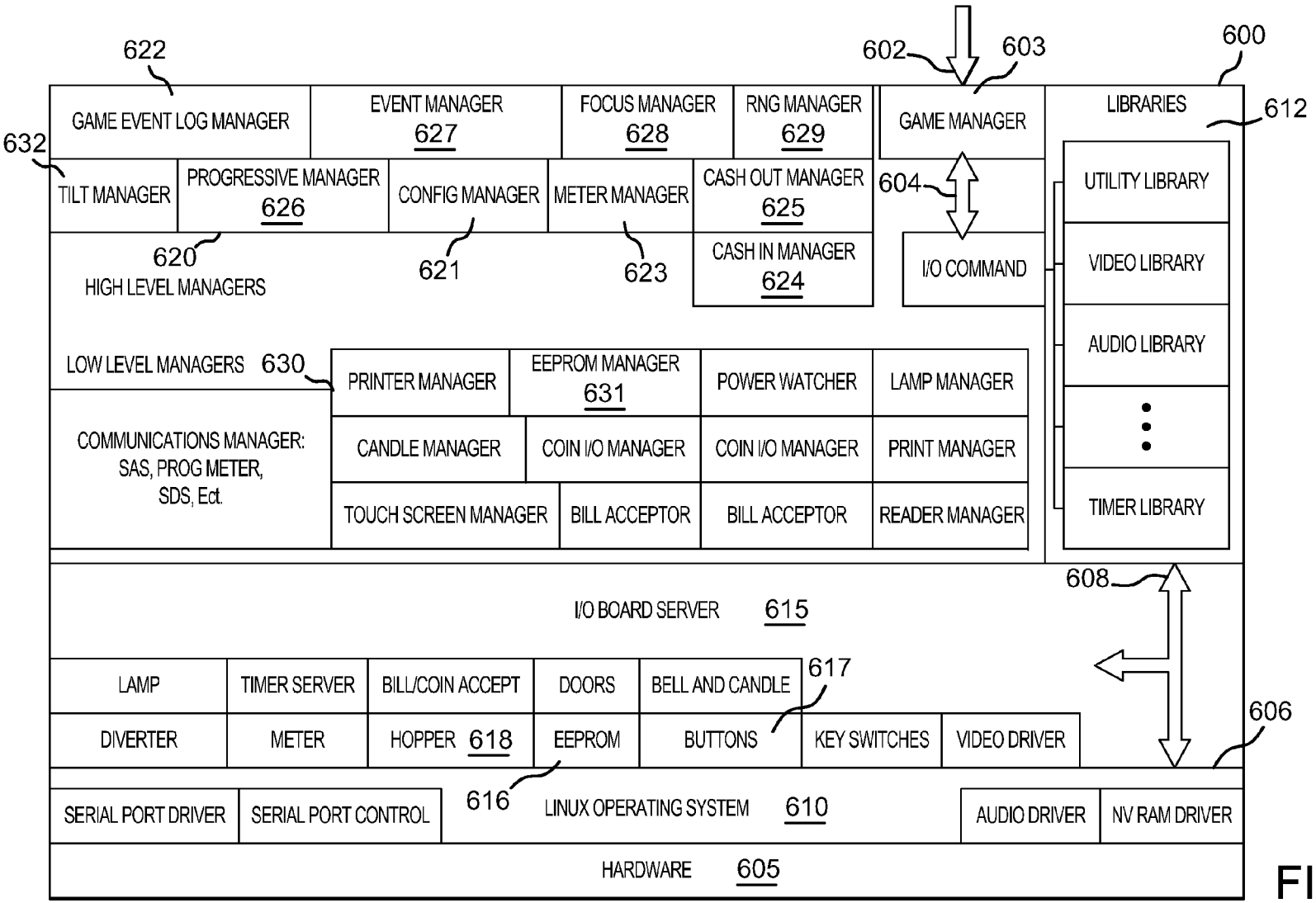
FIG. 6 is a block diagram of the logical components of a gaming kernel in accordance with one or more embodiments of the invention.

In accordance with one or more embodiments, FIG. 6 is a functional block diagram of a gaming kernel 600 of a game program under control of processor board 503, uses gaming kernel 600 by calling into application programming interface (API) 602, which is part of game manager 603. The components of game kernel 600 as shown in FIG. 6 are only illustrative, and should not be considered limiting. For example, the number of managers may be changed, additional managers may be added or some managers may be removed without deviating from the scope and spirit of the invention.

As shown in the example, there are three layers: a hardware layer 605; an operating system layer 610, such as, but not limited to, Linux; and a game kernel layer 600 having game manager 603 therein. In one or more embodiments, the use of a standard operating system 610, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 600 executes at the user level of the operating system 610, and itself contains a major component called the I/O Board Server 615. To properly set the bounds of game application software (making integrity checking easier), all game applications interact with gaming kernel 600 using a single API 602 in game manager 603. This enables game applications to make use of a well-defined, consistent interface, as well as making access points to gaming kernel 600 controlled, where overall access is controlled using separate processes.

For example, game manager 603 parses an incoming command stream and, when a command dealing with I/O comes in (arrow 604), the command is sent to an applicable library routine 612. Library routine 612 decides what it needs from a device, and sends commands to I/O Board Server 615 (see arrow 608). A few specific drivers remain in operating system 610's kernel, shown as those below line 606. These are built-in, primitive, or privileged drivers that are (i) general (ii) kept to a minimum and (iii) are easier to leave than extract. In such cases, the low-level communications is handled within operating system 610 and the contents passed to library routines 612.

Thus, in a few cases library routines may interact with drivers inside operating system 610, which is why arrow 608 is shown as having three directions (between library utilities 612 and I/O Board Server 615, or between library utilities 612 and certain drivers in operating system 610). No matter which path is taken, the logic needed to work with each device is coded into modules in the user layer of the diagram. Operating system 610 is kept as simple, stripped down, and common across as many hardware platforms as possible. The library utilities and user-level drivers change as dictated by the game cabinet or game machine in which it will run. Thus, each game cabinet or game machine may have an industry standard processor board 505 connected to a unique, relatively dumb, and as inexpensive as possible I/O adapter board 540, plus a gaming kernel 600 which will have the game-machine-unique library routines and I/O Board Server 615 components needed to enable game applications to interact with the gaming machine cabinet. Note that these differences are invisible to the game application software with the exception of certain functional differences (i.e., if a gaming cabinet has stereo sound, the game application will be able make use of API 602 to use the capability over that of a cabinet having traditional monaural sound).

Game manager 603 provides an interface into game kernel 600, providing consistent, predictable, and backwards compatible calling methods, syntax, and capabilities by way of game application API 602. This enables the game developer to be free of dealing directly with the hardware, including the freedom to not have to deal with low-level drivers as well as the freedom to not have to program lower level managers 630, although lower level managers 630 may be accessible through game manager 603's interface 602 if a programmer has the need. In addition to the freedom derived from not having to deal with the hardware level drivers and the freedom of having consistent, callable, object-oriented interfaces to software managers of those components (drivers), game manager 603 provides access to a set of upper level managers 620 also having the advantages of consistent callable, object-oriented interfaces, and further providing the types and kinds of base functionality required in casino-type games. Game manager 603, providing all the advantages of its consistent and richly functional interface 602 as supported by the rest of game kernel 600, thus provides a game developer with a multitude of advantages.

Game manager 603 may have several objects within itself, including an initialization object (not shown). The initialization object performs the initialization of the entire game machine, including other objects, after game manager 603 has started its internal objects and servers in appropriate order. In order to carry out this function, the kernel's configuration manager 621 is among the first objects to be started; configuration manager 621 has data needed to initialize and correctly configure other objects or servers.

The upper level managers 620 of game kernel 600 may include game event log manager 622 which provides, at the least, a logging or logger base class, enabling other logging objects to be derived from this base object. The logger object is a generic logger; that is, it is not aware of the contents of logged messages and events. The log manager's (622) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 623 manages the various meters embodied in the game kernel 600. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 623 receives its initialization data for the meters, during startup, from configuration manager 621. While running, the cash in (624) and cash out (625) managers call the meter manager's (623) update functions to update the meters. Meter manager 623 will, on occasion, create backup copies of the soft meters by storing the soft meters' readings in EEPROM. This is accomplished by calling and using EEPROM manager 631.

In accordance with still other embodiments, progressive manager 626 manages progressive games playable from the game machine. Event manager 627 is generic, like log manager 622, and is used to manage various gaming machine events. Focus manager 628 correlates which process has control of various focus items. Tilt manager 632 is an object that receives a list of errors (if any) from configuration manager 621 at initialization, and during game play from processes, managers, drivers, etc. that may generate errors. Random number generator manager 629 is provided to allow easy programming access to a random number generator (RNG), as a RNG is required in virtually all casino-style (gambling) games. RNG manager 629 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 625 has the responsibility of configuring and managing monetary output devices. During initialization, cash out manager 625, using data from configuration manager 621, sets the cash out devices correctly and selects any selectable cash out denominations. During play, a game application may post a cash out event through the event manager 627 (the same way all events are handled), and using a callback posted by cash out manager 625, cash out manager 625 is informed of the event. Cash out manager 625 updates the credit object, updates its state in non-volatile memory, and sends an appropriate control message to the device manager that corresponds to the dispensing device. As the device dispenses dispensable media, there will typically be event messages being sent back and forth between the device and cash out manager 625 until the dispensing finishes, after which cash out manager 625, having updated the credit manager and any other game state (such as some associated with meter manager 623) that needs to be updated for this set of actions, sends a cash out completion event to event manager 627 and to the game application thereby. Cash in manager 624 functions similarly to cash out manager 625, only controlling, interfacing with, and taking care of actions associated with cashing in events, cash in devices, and associated meters and crediting.

In a further example, in accordance with one or more embodiments, I/O server 615 may write data to the gaming machine EEPROM memory, which is located in the gaming machine cabinet and holds meter storage that must be kept even in the event of power failure. Game manager 603 calls the I/O library functions to write data to the EEPROM. The I/O server 615 receives the request and starts a low priority EEPROM thread 616 within I/O server 615 to write the data. This thread uses a sequence of 8 bit command and data writes to the EEPROM device to write the appropriate data in the proper location within the device. Any errors detected will be sent as IPC messages to game manager 603. All of this processing is asynchronous.

In accordance with one embodiment, button module 617 within I/O server 615, polls (or is sent) the state of buttons every two milliseconds. These inputs are debounced by keeping a history of input samples. Certain sequences of samples are required to detect a button was pressed, in which case the I/O server 615 sends an inter-process communication event to game manager 603 that a button was pressed or released. In some embodiments, the gaming machine may have intelligent distributed I/O which debounces the buttons, in which case button module 617 may be able to communicate with the remote intelligent button processor to get the button events and simply relay them to game manager 603 via IPC messages. In still another embodiment, the I/O library may be used for pay out requests from the game application. For example, hopper module 618 must start the hopper motor, constantly monitor the coin sensing lines of the hopper, debounce them, and send an IPC message to the game manager 603 when each coin is paid.

Further details, including disclosure of lower level fault handling and/or processing, are included in U.S. Pat. No. 7,351,151 entitled "Gaming Board Set and Gaming Kernal for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 7:
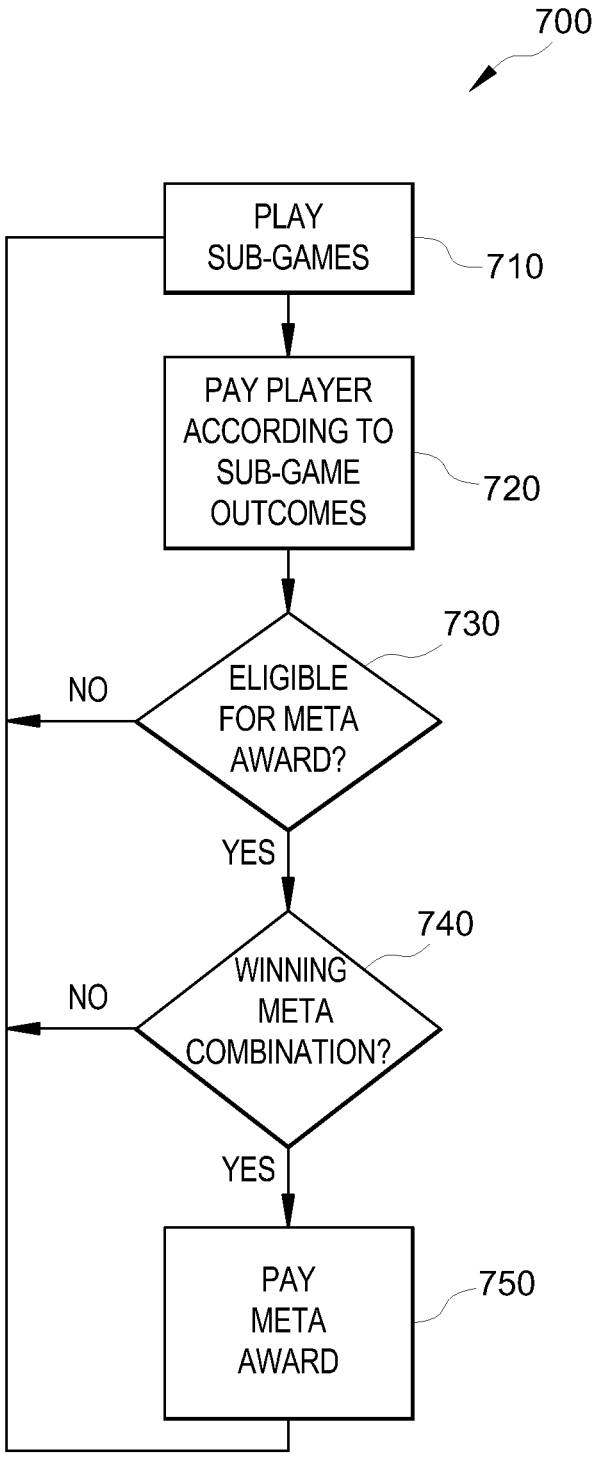
FIG. 7 is a functional block diagram depicting the steps associated with carrying out an example method in accordance with one or more embodiments.

A logical flow diagram generally depicting the steps associated with a method 700 for carrying out a game having a primary game award at least partially dependent on the outcomes of one or more sub-games, in accordance with one aspect of the invention, is presented in FIG. 7. The order of actions as shown in FIG. 7 is only illustrative, and should not be considered limiting. For example, the order of the actions may be changed, additional steps may be added or some steps may be removed without deviating from the scope and spirit of the invention.

First at block 710, the mini-games or sub-games are played as described above. In one embodiment, the games are started according to a player's wager (selecting a number of mini-games to play and how many credits to wager on each of the mini-games). The mini-games then spin, whereby each reel then displays a representation of a slot machine reel spin before stopping with particular indicia displayed to the player. A mini-game win occurs if a series of indicia (BAR, BAR, BAR, for example) appears on one or more pay lines and the player may be paid for any winning symbol combinations at block 720, for example, by applying won credits to an interim game meter or directly to a main credit meter. At block 730, it is determined whether the player is eligible to win a meta-award. If not, perhaps because the player did not wager enough, play enough mini-games or place a required side bet, or otherwise meet eligibility requirements, as described above, play continues at box 710 with initiation of another round of sub-games.

In the case where the player is eligible for a possible meta-award, the mini-game outcomes are compared to the meta game rules and pay tables, examples of which have been given above, at box 740. Any winning amount associated with the meta award is paid to the player at box 750 and another round of sub-games is then initiated at box 710.

Figure 8A:
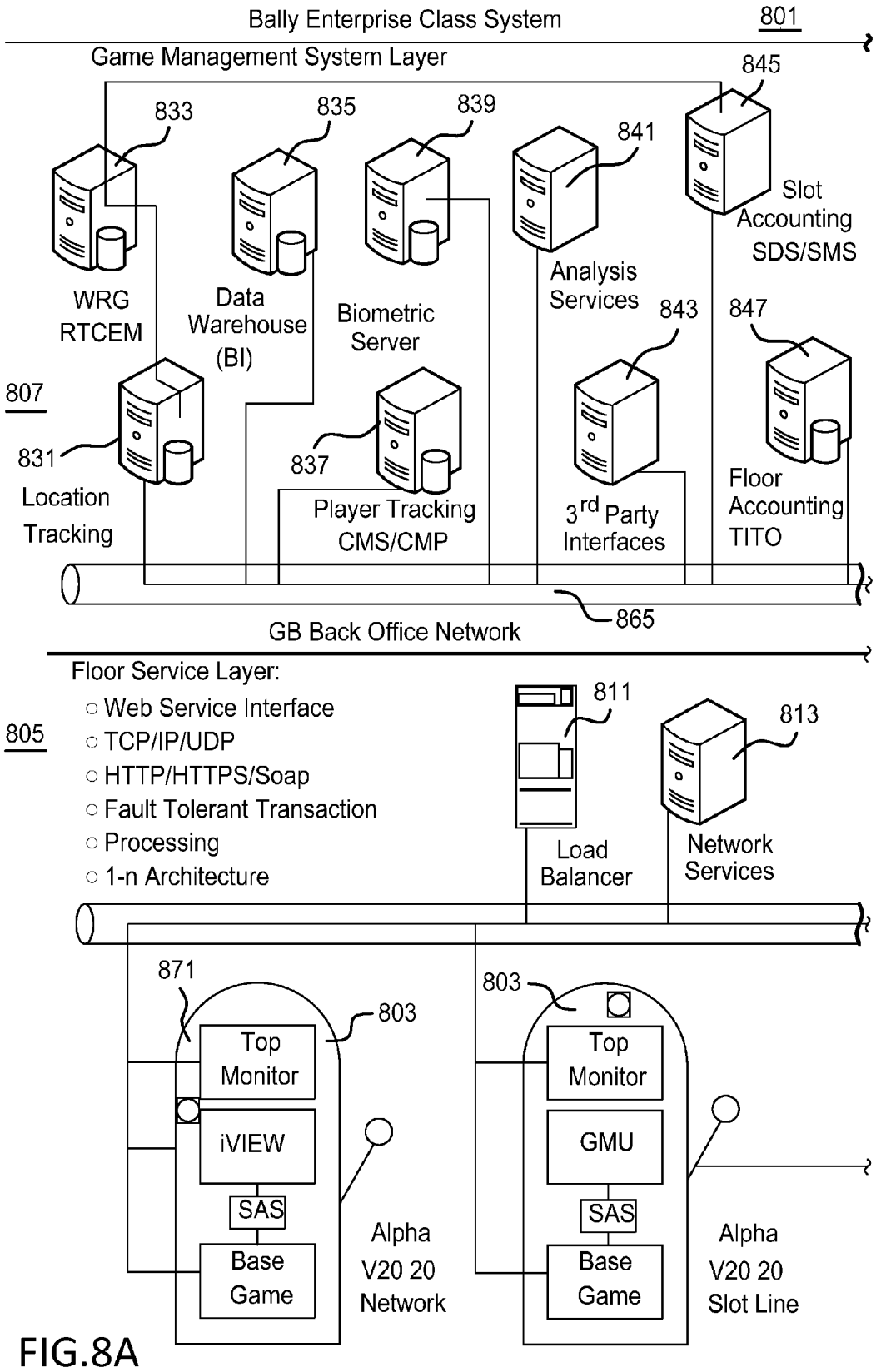
FIGS. 8A and 8B illustrate a schematic block diagram showing the hardware elements of a networked gaming system in accordance with one or more embodiments.
Figure 8B:
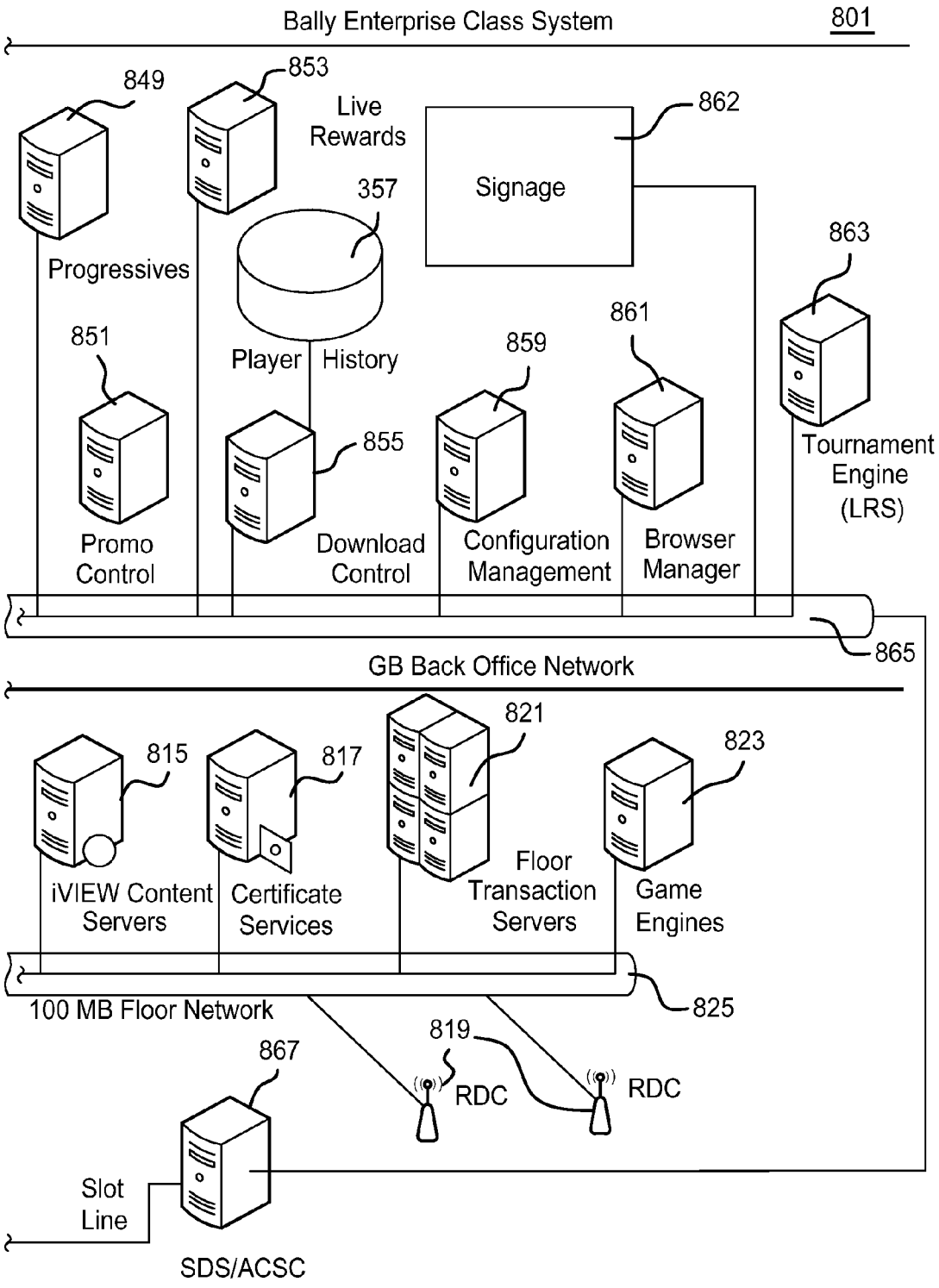

Referring to FIGS. 8A and 8B, enterprise gaming system 801 is shown in accordance with one or more embodiments. Enterprise gaming system 801 may include one casino or multiple locations and generally includes a network of gaming machines 803, floor management system (SMS) 805, and casino management system (CMS) 807. SMS 805 may include load balancer 811, network services servers 813, player interface (iVIEW) content servers 815, certificate services server 817, floor radio dispatch receiver/transmitters (RDC) 819, floor transaction servers 821 and game engines 823, each of which may connect over network bus 825 to gaming machines 803. CMS 807 may include location tracking server 831, WRG RTCEM server 833, data warehouse server 835, player tracking server 837, biometric server 839, analysis services server 841, third party interface server 843, slot accounting server 845, floor accounting server 847, progressives server 849, promo control server 851, bonus game (such as Bally Live Rewards) server 853, download control server 855, player history database 857, configuration management server 859, browser manager 861, tournament engine server 863 connecting through bus 865 to server host 867 and gaming machines 803. The various servers and gaming machines 803 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and gaming machines 803. SMS 805 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

Gaming machines 803 include various peripheral components that may be connected with USB, serial, parallel, RS-485 or Ethernet devices/architectures to the system components within the respective gaming machine. The GMU has a connection to the base game through a serial SAS connection. The system components in the gaming cabinet may be connected to the servers using HTTPs or G2S over Ethernet. Using CMS 807 and/or SMS 305 servers and devices, firmware, media, operating systems, and configurations may be downloaded to the system components of respective gaming machines for upgrading or managing floor content and offerings in accordance with operator selections or automatically depending upon CMS 807 and SMS 805 master programming. The data and programming updates to gaming machines 803 are authenticated using conventional techniques prior to install on the system components.

In various embodiments, any of the gaming machines 803 may be a mechanical reel spinning slot machine, video slot machine, video poker machine, keno machine, bingo machine, or a gaming machine offering one or more of the above described games including a group play game. Alternately, gaming machines 803 may provide a game with adjustable multi-part indicia as one of a set of multiple primary games selected for play by a random number generator, as described above. A gaming system of the type described above also allows a plurality of games in accordance with the various embodiments of the invention to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A gaming machine comprising:

a processor operatively coupled to a set of player-operable controls;

a plurality of sub-games from one or more of a reel game, wheel game, bingo game, poker game, or keno game stored in a non-transitory memory device, one or more of which may be enabled by the processor in accordance with the player-operable controls, each enabled sub-game comprising a sub-game outcome further comprising an associated probability of occurrence and associated with a set of possible sub-game awards; and a payout device for paying at least one meta-game award distinct from the sub-game awards, the meta-game award based on at least one of the sub-game outcomes, wherein a theoretical hold percentage of the meta game is maintained by altering the probability of the sub-game outcomes associated with the meta-game award based on the number of sub-games enabled for play.

2. The gaming machine of claim 1 further comprising a wager input mechanism operatively coupled to the processor, wherein payment of the at least one meta-game award is restricted by an amount of a wager placed by way of the wager input mechanism.

3. The gaming machine of claim 1 wherein the at least one meta-award comprises one or more progressive awards.

4. The gaming machine of claim 1 further comprising a video display operatively coupled to the processor.

5. The gaming machine of claim 4 wherein the display is a wide-screen display.

6. The gaming machine of claim 4 further comprising a touch screen attached to the display, wherein the touch-screen is used by the player to select the sub-games to be enabled.

7. The gaming machine of claim 1 wherein each sub-game outcome is randomly or pseudo-randomly determined.

8. The gaming machine of claim 1 wherein the sub-game outcomes are displayed on one or more reels.

9. The gaming machine of claim 1 wherein the player selects each sub-game from a set of possible sub-games by way of the interface.

10. The gaming machine of claim 1 wherein the game enables sub-games for play based upon criteria established by the player.

11. The gaming machine of claim 1 wherein the meta-game award is further based on the number of sub-games enabled for play.

12. The gaming machine of claim 1 further comprising one or more reels, wherein the sub-game outcomes are displayed on the one or more reels.

* * * * *